US007940291B2

(12) United States Patent
Koyabu

(10) Patent No.: US 7,940,291 B2
(45) Date of Patent: May 10, 2011

(54) RECORDING DEVICE, CONTROL METHOD FOR A RECORDING DEVICE, AND A CONTROL PROGRAM

(75) Inventor: Akira Koyabu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 1 day.

(21) Appl. No.: 12/459,805

(22) Filed: Jul. 7, 2009

(65) Prior Publication Data

US 2010/0002065 A1 Jan. 7, 2010

(30) Foreign Application Priority Data

Jul. 7, 2008 (JP) ..... 2008-176488

(51) Int. Cl.
*B41J 11/00* (2006.01)

(52) U.S. Cl. ..... 347/218

(58) Field of Classification Search ..... 347/215, 347/218, 171

See application file for complete search history.

(56) References Cited

U.S. PATENT DOCUMENTS 5,354,588 A * 10/1994 Mitchell et al. ..... 428/41.6
2004/0090517 A1 5/2004 Nishimura

FOREIGN PATENT DOCUMENTS

JP 9-011578 1/1997
JP 11-320989 11/1999
JP 2001-302052 A 10/2001
JP 2002-144654 A 5/2002

OTHER PUBLICATIONS

Machine-generated translation of JP 2002-144654, published on May 22, 2002.*
European Search Report issued Mar. 26, 2010, during the prosecution of European Application No. 09008817.

* cited by examiner

*Primary Examiner* — Huan H Tran

(57) ABSTRACT

If the recording medium and the thermal head stick together, a recording device, a control method for a recording device, and a control program enable avoiding media transportation problems caused by such adhesion. If the recording medium has a release coat layer or an overcoating layer and the recording medium is left in contact with the thermal head, an operating pattern is set according to the contact conditions for moving the surface of the recording medium a specific distance from the thermal head, and transportation is controlled according to the set operating pattern.

8 Claims, 8 Drawing Sheets

RECORDING DEVICE, CONTROL METHOD FOR A RECORDING DEVICE, AND A CONTROL PROGRAM

This application claims priority under 35 U.S.C. §119 to Japanese Patent Application No. 2008-176488 filed on Jul. 7, 2008, the entire disclosure of which is expressly incorporated by reference herein.

BACKGROUND OF THE INVENTION

1. Field of Invention

The present invention relates to a recording device that has a thermal head, to a control method for a recording device, and to a control program, and relates more particularly to technology that prevents media transportation problems resulting from the thermal head and the recording medium sticking together.

2. Description of Related Art

Thermal printers (also called direct thermal printers) that record images of text and other content on thermal paper are known from the literature as one type of recording device for recording images on a recording medium. If a thermal printer of this type is left with the thermal paper held pressed between the thermal head and platen roller in the standby mode, the thermal paper can become stuck to the platen roller or the thermal head if the standby mode lasts for long or if the standby mode is short but the printer is used in a demanding high or low temperature environment.

To avoid this, Japanese Unexamined Patent Appl. Pub. JP-A-H11-320989 teaches turning the platen roller forward, reverse, and then forward when the standby mode lasts for a specified period of time in order to prevent the thermal paper from sticking completely. More specifically, JP-A-H11-320989 describes preventing adhesion by rotating the platen roller before the thermal paper and thermal head stick together as a result of pressure bonding between the thermal paper and thermal head caused by applying pressure therebetween for an extended time, fusion in a high temperature environment, or freezing in a low temperature environment.

Linerless label paper eliminates the liner that is commonly used to carry adhesive labels and becomes waste after the labels are removed, and thermal printers for recording on linerless label roll paper, which is linerless label paper wound into a roll, are conceivable.

Linerless label roll paper is coated with a release coating on the label side and with adhesive on the back side, and is wound into a roll with the adhesive side against the release coating layer. As a result, if the label paper is conveyed passed the thermal head with adhesive remaining on the release coating layer, the linerless label roll paper will quickly stick to the thermal head. The paper thus sticking to the thermal head can lead to paper transportation problems, resulting in the feed pitch being disrupted when paper feeding starts at the start of printing and other paper transportation errors.

If the method taught in JP-A-H11-320989 is applied to prevent such sticking, the platen roller must be frequently driven rotationally to prevent sticking because JP-A-H11-320989 is not intended for use with recording paper that has a sticky surface layer. As a result, operation becomes complicated or the interval between operations becomes too long and the paper cannot be separated.

The problem of the paper quickly sticking to the surface of the thermal head is not limited to linerless label paper, and may also occur when an overcoating has been applied to protect the surface.

SUMMARY OF THE INVENTION

A recording device, a control method for a recording device, and a control program according to the present invention enable avoiding media transportation problems caused by adhesion between the recording medium and the thermal head if such adhesion occurs.

A first aspect of the invention is a recording device having a transportation unit that conveys a recording medium; a thermal head that records images to the recording medium; and a control unit that, when the recording medium has a release coat layer or an overcoating layer and the recording medium is left in contact with the thermal head, sets an operating pattern according to the contact conditions for moving the surface of the recording medium a specific distance relative to the thermal head, and controls the transportation unit according to the set operating pattern.

Because this aspect of the invention has a control unit that, when the recording medium has a release coat layer or an overcoating layer and the recording medium is left in contact with the thermal head, sets an operating pattern according to the contact conditions for moving and separating the surface of the recording medium a specific distance relative to the thermal head, and controls the transportation unit according to the set operating pattern, the surface of the recording medium can be reliably separated from the thermal head even if the surface of the recording medium and the thermal head have stuck together, and media transportation problems caused by such adhesion can be avoided.

Preferably, the control unit sets the operating pattern that causes the recording medium to be conveyed in reverse and then forward. Problems that can occur when operation starts with forward transportation, such as paper slack accumulating inside the recording device because the recording medium is jerked forward, are prevented and the recording medium can be efficiently separated.

Further preferably, the control unit acquires cause information that affects adhesion strength between the recording medium and the thermal head, and sets the operating pattern based on the cause information. This aspect of the invention can set an operating pattern that avoids unnecessary operation, and can reduce noise and power consumption.

Yet further preferably, the control unit sets an operating time interval of the transportation unit, and at least one of whether operation is intermittent during reverse transportation and forward transportation and the number of intermittent operations, based on the cause information. Yet further preferably, the cause information is at least one of temperature and humidity.

Another aspect of the invention the recording medium is linerless label paper having a release coat layer on the front and an adhesive layer on the back, and is pulled from a condition in which the adhesive layer is on top of the release coat layer and conveyed by the transportation unit.

Another aspect of the invention is a control method for a recording device that has a transportation unit that conveys a recording medium, and a thermal head that records images to the recording medium, the control method having a step of setting, when a recording medium having a release coat layer or an overcoating layer is left in contact with the thermal head, an operating pattern for moving the surface of the recording medium a specific distance relative to the thermal head according to the contact conditions, and controlling the transportation unit according to the set operating pattern. With this aspect of the invention the surface of the recording medium can be reliably separated from the thermal head even if the surface of the recording medium and the thermal head have stuck together, and media transportation problems caused by such adhesion can be avoided.

Another aspect of the invention is a control program for controlling by means of a computer a recording device that has a transportation unit that conveys a recording medium, and a thermal head that records images to the recording medium, the control program causing the computer to function as a control unit that, when a recording medium having a release coat layer or an overcoating layer is left in contact with the thermal head, sets an operating pattern according to the contact conditions for moving the surface of the recording medium a specific distance from the thermal head, and controls the transportation unit according to the set operating pattern. With this aspect of the invention the surface of the recording medium can be reliably separated from the thermal head even if the surface of the recording medium and the thermal head have stuck together, and media transportation problems caused by such adhesion can be avoided.

EFFECT OF THE INVENTION

When the recording medium has a release coat layer or an overcoating layer and the recording medium is left in contact with the thermal head, the invention sets an operating pattern according to the contact conditions for moving the surface of the recording medium a specific distance from the thermal head. Because transportation is controlled according to the set operating pattern, media transportation problems caused by adhesion between the recording medium and the thermal head can be avoided if they stick together.

Other objects and attainments together with a fuller understanding of the invention will become apparent and appreciated by referring to the following description and claims taken in conjunction with the accompanying drawings.

DESCRIPTION OF PREFERRED EMBODIMENTS

A preferred embodiment of the present invention is described below with reference to the accompanying figures.

Figure 1:
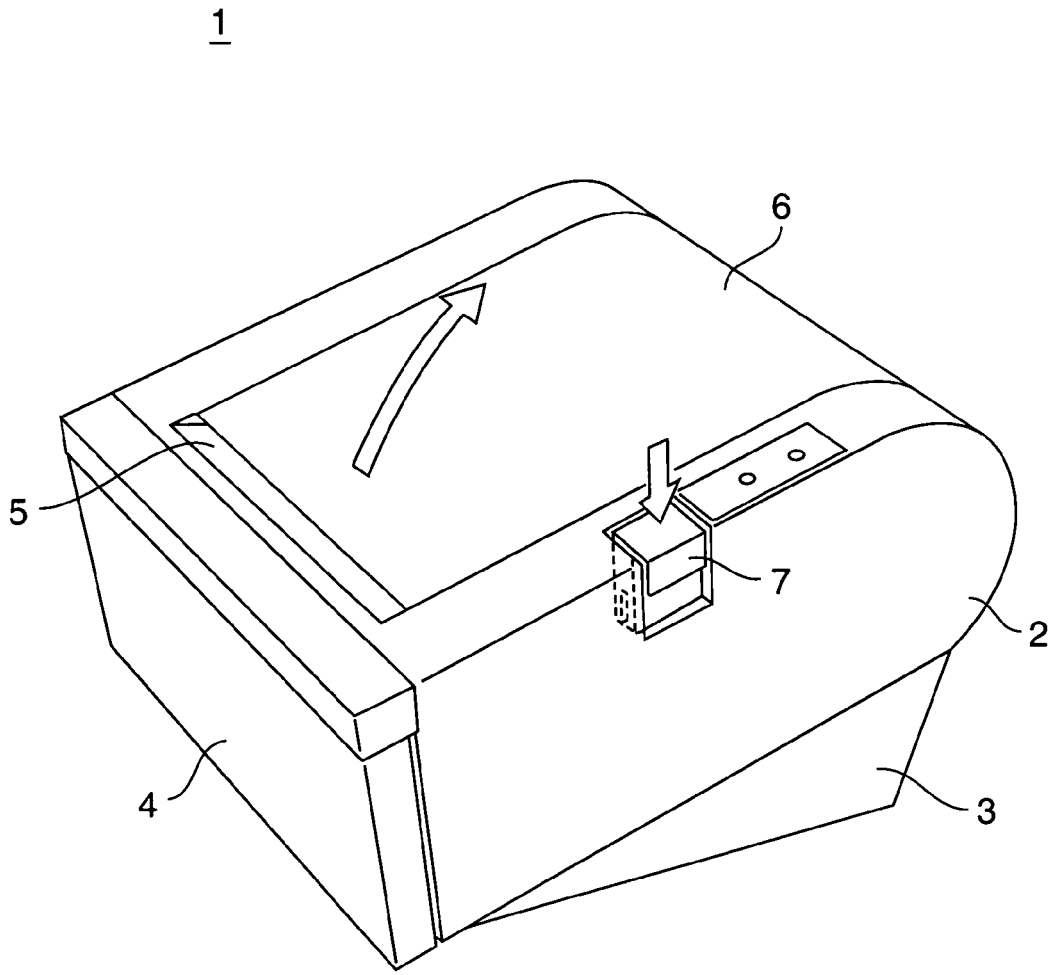
FIG. 1 is an oblique view of a thermal printer according to a preferred embodiment of the invention.
Figure 2:
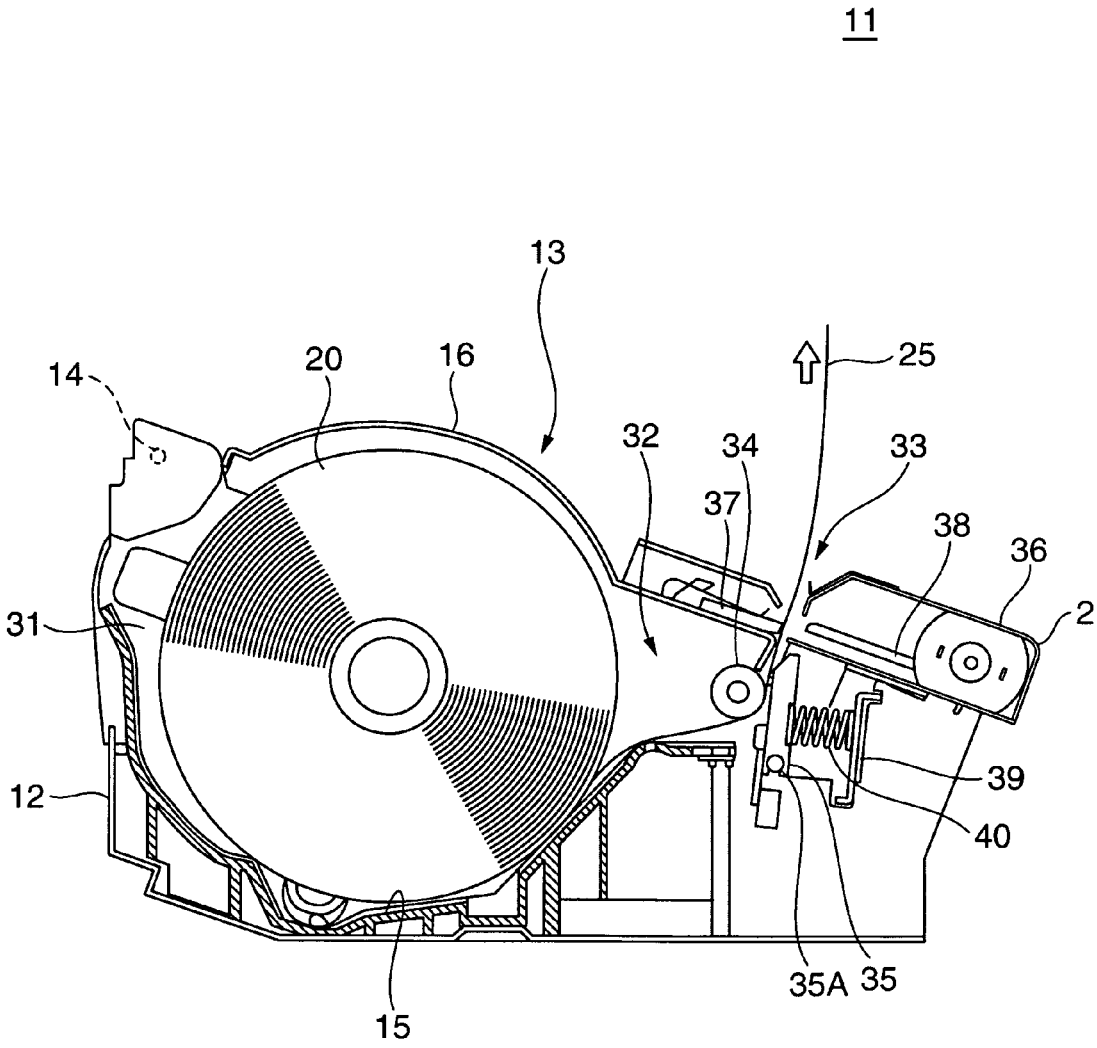
FIG. 2 shows the internal configuration of the thermal printer.

FIG. 1 is an oblique view of a thermal printer according to a preferred embodiment of the invention, and FIG. 2 shows the internal configuration of the thermal printer.

This thermal printer 1 is a direct thermal printer that uses linerless label roll paper (also referred to below as simply roll paper) having a web of linerless label paper wound into a roll as the recording medium, and thermally records images, including text, by means of a thermal head 35 (see FIG. 2). The thermal printer 1 can also thermally print to standard roll paper by simply replacing the linerless label roll paper 20 with standard roll paper (that is, roll paper without an adhesive surface).

As shown in FIG. 1 the thermal printer 1 has a top case 2, a bottom case 3, and a front cover 4 that render the outside case. The top case 2, bottom case 3, and front cover 4 enclose the printer assembly 11 shown in FIG. 2.

The top case 2 has an exit opening 5 extending widthwise to the top case 2, and a top cover 6 disposed to pivot open and closed as indicated by the arrow in FIG. 1. When the top cover 6 is open the linerless label roll paper 20 shown in FIG. 2 can be loaded and removed. An opening button 7 that releases a lock mechanism (not shown in the figure) that holds the top cover 6 closed so that the top cover 6 can be opened is disposed to the top side edge of the top case 2.

As shown in FIG. 2, the printer assembly 11 has a box-like main frame 12 that is open to the top, a cover frame 13 that is disposed to open and close to the main frame 12 pivoting on a support shaft 14, a roll paper compartment 31 that is formed between the frames 12 and 13 to hold the roll paper 20, a platen roller 34 that conveys the linerless label paper 25 pulled off the roll paper 20 from the label delivery opening 32 to the label exit opening 33, a thermal head 35 disposed to a position opposite the platen roller 34 so that the linerless label paper 25 passes therebetween, and an automatic cutter mechanism 36 that cuts off the linerless label paper 25 discharged from the label exit opening 33 after recording is completed. Note that the cover frame 13 is attached to the back side of the top cover 6 and opens and closes in unison with the top cover 6.

The roll paper compartment 31 has a recessed bottom wall 15 rendered in the main frame 12 with a substantially circular arc shape conforming generally to the outside shape of the roll paper 20, and a protruding cover 16 with a substantially circular arc shape disposed to the cover frame 13 above the recessed bottom wall 15, that form the storage space of the roll paper 20.

The platen roller 34 extends widthwise to the printer assembly 11 and is supported on the cover frame 13. As a result, the platen roller 34 moves upward in unison with the cover frame 13 when the cover frame 13 opens, the platen roller 34 therefore does not interfere with loading and removing the roll paper 20, and the roll paper 20 can be easily loaded and removed.

A gear not shown is disposed to one end of the platen roller 34, and a transportation motor 43 described below and a gear train (not shown in the figure) that meshes with the platen roller 34 gear when the cover frame 13 is closed are disposed to the main frame 12. Drive power from the transportation motor 43 is transferred through this gear train to the platen roller 34, and the linerless label paper 25 is conveyed by rotation of the platen roller 34.

The thermal head 35 is a line thermal head having an array of heating elements in a line extending widthwise, and is supported freely pivotably on the main frame 12 by a support shaft 35A. A pressure plate 39 attached to the main frame 12 is positioned on the back side of the thermal head 35, and an urging member 40 (a coil spring in this embodiment of the invention) is inserted between the pressure plate 39 and the thermal head 35. This urging member 40 urges the thermal head 35 to the platen roller 34 side in contact with the linerless label paper 25. It should be noted that the head surface of the thermal head 35 has a glass member to protect the heating elements, to impart heat transferability for conducting heat from the heating elements, and to impart wear resistance.

The automatic cutter mechanism 36 has a fixed knife 37 and a moving knife 38. The fixed knife 37 is attached to the cover frame 13, and the moving knife 38 is attached to the main frame 12 so that the moving knife 38 can advance and retract perpendicularly to the linerless label paper 25. When the cover frame 13 closes, the fixed knife 37 and moving knife 38 are disposed in mutual opposite with the roll paper 20 transportation path therebetween. When the moving knife 38 is driven by a moving knife drive unit (not shown in the figure), the moving knife 38 and the fixed knife 37 intersect and cut the linerless label paper 25.

Figure 3:
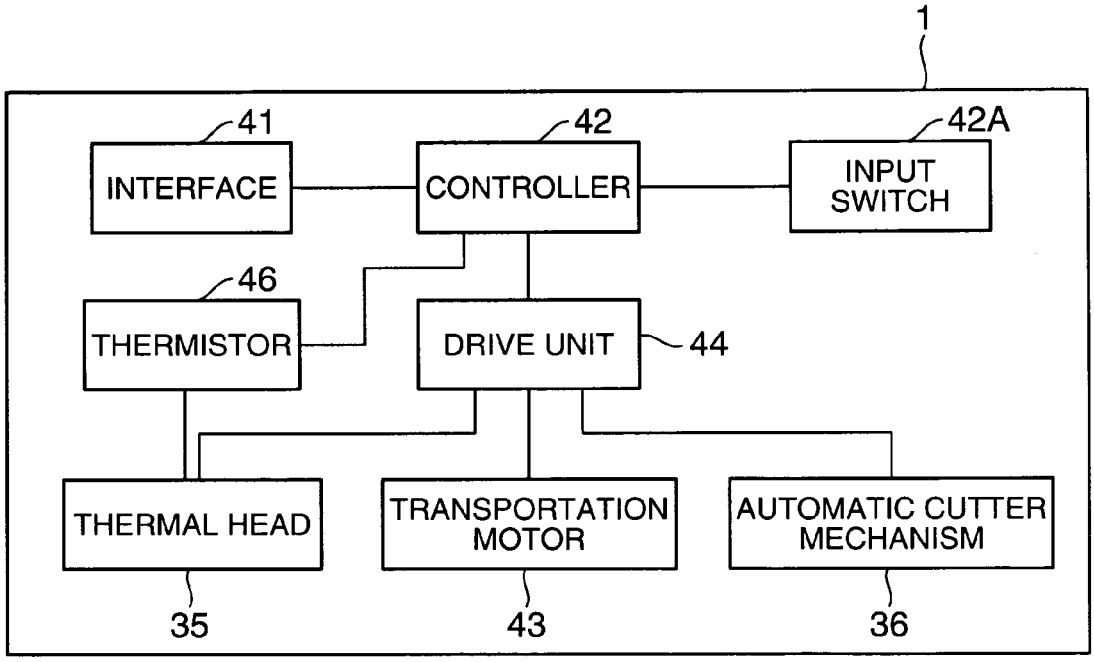
FIG. 3 is a block diagram showing the electrical configuration of the thermal printer.

FIG. 3 is a block diagram showing the electrical configuration of the thermal printer 1.

The thermal printer 1 has an interface 41 for communicating with the host computer (not shown in the figure) to exchange print data and other information for each print job, a controller (control unit) 42 that controls the other parts of the thermal printer 1, a transportation motor 43 for rotationally driving the platen roller 34, a drive unit 44 (transportation unit) including drive circuits for driving the thermal head 35, the transportation motor 43, and the automatic cutter mechanism 36 as instructed by the controller 42, and a thermistor 46 (temperature detection unit) for detecting the temperature of the thermal head 35.

The controller 42 is a computer including a CPU, ROM, and RAM, and centrally controls the other parts of the thermal printer 1 by means of the CPU executing a control program stored in ROM. For example, when print data is received through the interface 41, the controller 42 interprets the print data and writes image data to be printed on the linerless label paper 25 to RAM. The controller 42 also extracts control data specifying the printing conditions for printing operations and what operations to perform before and after printing from the received print data, and operates according to this control data.

In addition to specifying such parameters as the print margins and print density, this control data also specifies whether or not to advance the paper to insert a margin between pages, whether or not to cut the linerless label paper 25 between pages by means of the automatic cutter mechanism 36, whether or not to advance the paper to insert a margin between jobs, and whether or not to cut the linerless label paper 25 between jobs by means of the automatic cutter mechanism 36, for example.

More specifically, by controlling the drive unit 44 according to the control data and print data, the controller 42 causes the transportation motor 43 and automatic cutter mechanism 36 to operate in order to execute the operations specified by the control data, and drives the thermal head 35 to print according to the image data stored in internal RAM. The thermal printer 1 thus pulls the linerless label paper 25 from the roll paper 20, prints an image, and cuts the paper.

The controller 42 also has an input switch 42A for changing the operating mode according to whether the recording medium is linerless label roll paper 20 or standard roll paper. This input switch 42A may be a hardware switch such as a DIP switch or a software switch such as a memory switch. The controller 42 changes the operating mode according to the state of this input switch 42A. More specifically, when the linerless label roll paper 20 operating mode is selected, the roll paper has an overcoating layer as further described below, and the operating mode is therefore changed to a mode in which the head energy level is increased compared with using standard roll paper and the recording speed is slower.

The thermistor 46 is a temperature sensor used for print density control (recording density control). More specifically, because the thermal head 35 prints using heat emitted from the heating elements, the temperature of the thermal head itself necessarily rises. If the same head energy applied under normal temperature conditions is applied when the temperature is high, the print density will be too dense, and if the same head energy applied under normal temperature conditions is applied when the temperature is low, the print density will be too light. A thermistor 46 for measuring the temperature of the thermal head is therefore required on the thermal head 35, and the print density is appropriately controlled by the controller 42 based on the temperature detected by the thermistor 46.

Figure 4:
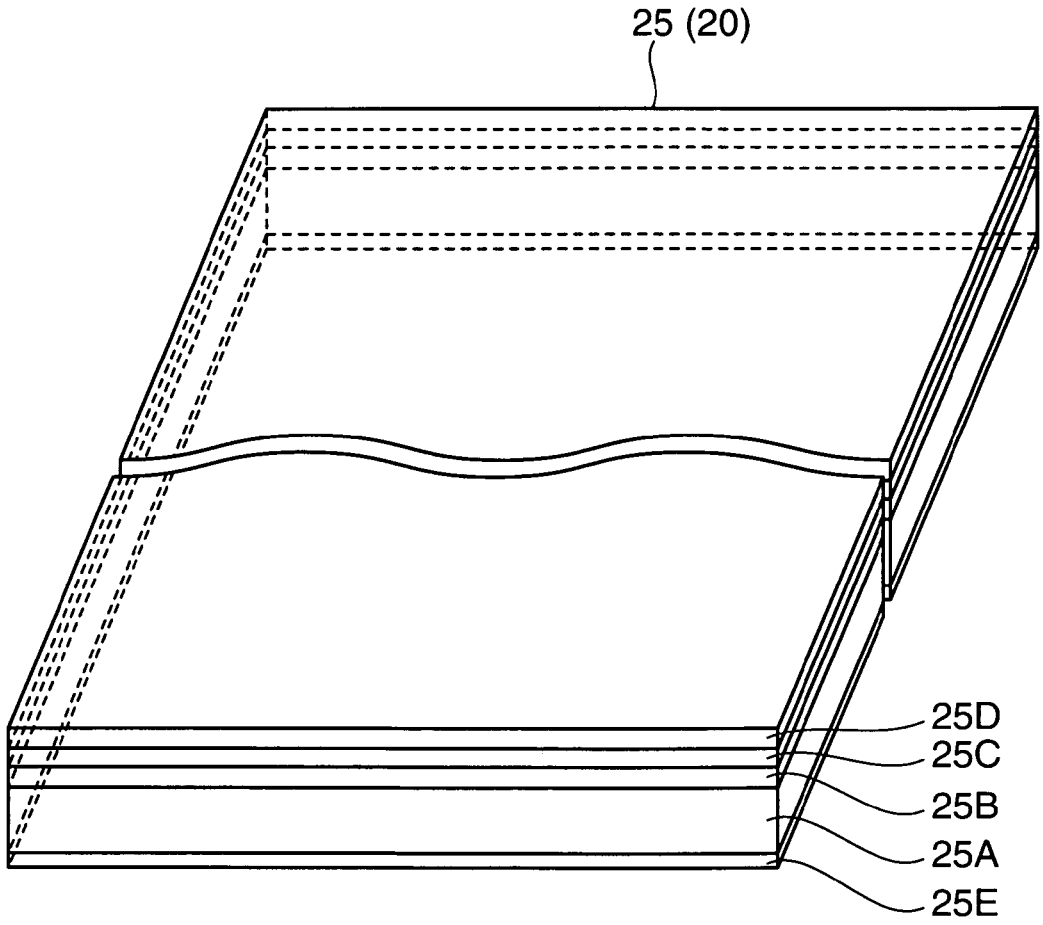
FIG. 4 shows the structure of linerless label paper.

FIG. 4 shows the structure of linerless label paper 25 (linerless label roll paper 20). As shown in the figure, the linerless label paper 25 has a thermosensitive color-producing layer 25B, an overcoating layer 25C to protect the surface of the thermosensitive color-producing layer 25B, and a release coating layer 25D sequentially laminated on one side of a base layer 25A, which is a long web of paper or other medium, and an adhesive layer 25E formed on the opposite side of the base layer 25A.

The surface layer of the recording surface of the linerless label paper 25 is formed by the release coating layer 25D, which enables releasing the adhesive layer 25E. The linerless label roll paper 20 is formed by winding the linerless label paper 25 into a roll with the adhesive layer 25E on the back side in direct contact with this release coating layer 25D without an intervening liner.

If the linerless label paper 25 is pulled from the linerless label roll paper 20 and is left in contact with the thermal head 35 (referred to below as a "paper-in-contact condition") when adhesive from the adhesive layer 25E is left on the release coating layer 25D of the linerless label paper 25, the linerless label paper 25 will quickly stick to the head surface, which is made of glass. This adhesion can lead to paper transportation problems, and can result in deviation in the feed pitch when paper transportation starts at the start of printing and other paper transportation errors.

This adhesion can also occur between the adhesive layer 25E of the linerless label paper 25 and the platen roller 34. We discovered that the adhesion strength between the linerless label paper 25 and the platen roller 34 can be rendered significantly lower than the adhesion strength between the linerless label paper 25 and the thermal head 35 by selecting a suitable material for the platen roller 34, and the problem is therefore mainly caused by adhesion between the linerless label paper 25 and the thermal head 35.

Figure 5A:
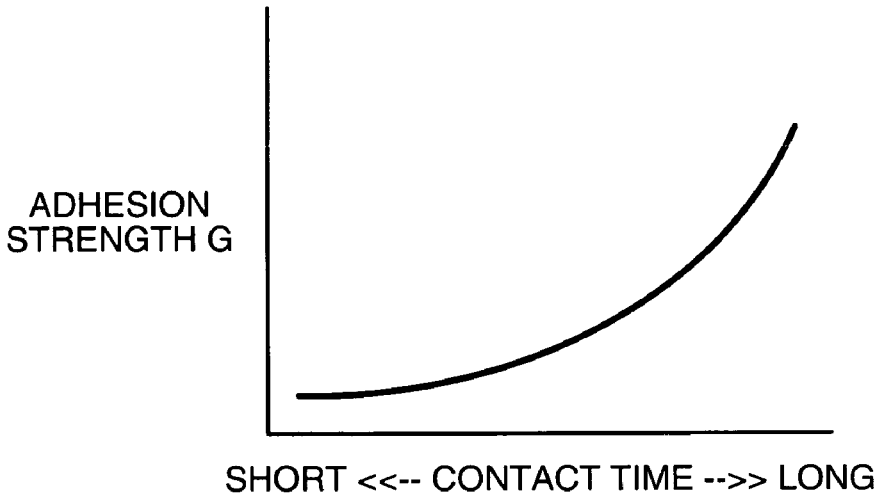
FIG. 5A is a graph showing the relationship between adhesion strength between the linerless label paper and the thermal head and the time left in contact.
Figure 5B:
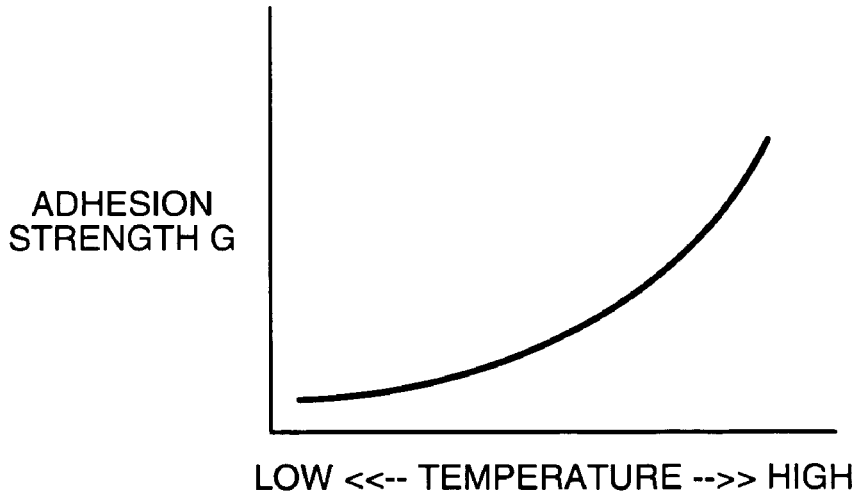
FIG. 5B is a graph showing the relationship between adhesion strength and temperature.

Through further investigation into adhesion between the linerless label paper 25 and the thermal head 35, we also discovered that the linerless label paper 25 begins sticking to the thermal head 35 in only a few minutes, and the rise in adhesion strength G accelerates as the time of contact between the linerless label paper 25 and thermal head 35 increases as shown in FIG. 5A. Furthermore, because this adhesion problem is caused by adhesive that is left on the release coating layer 25D, the adhesion strength increases when the temperature is high because the adhesive absorbs moisture from the air or melts, and the adhesion strength G rises as the temperature rises as shown in FIG. 5B. More specifically, the ambient temperature affects the increase in the adhesion strength between the linerless label paper 25 and the thermal head 35, and can be used as cause information. Note that FIG. 5B is a characteristic curve showing the adhesion strength G after a constant time has passed under different temperature conditions.

Figure 6:
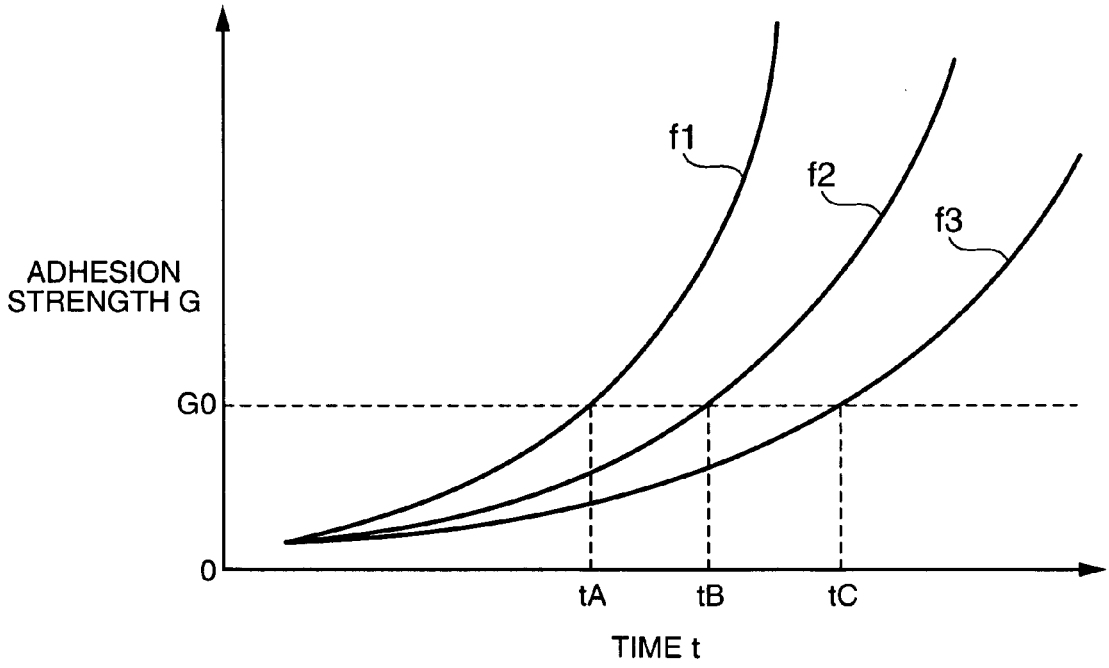
FIG. 6 is a graph showing the time change in adhesion strength when the temperature condition changes.

Based on the results of these investigations, we acquired the time change characteristic of the adhesion strength G under different temperature conditions as shown in FIG. 6. In this figure curve f1 shows the change in adhesion strength G under a high temperature condition, curve f2 shows the change in adhesion strength G under a normal temperature condition (where the temperature<high temperature condition), and curve f3 shows the change in adhesion strength G under a low temperature condition (where the temperature<normal temperature condition).

As will be known from FIG. 6, the higher the temperature the higher the adhesion strength G and the lower the temperature the lower the adhesion strength G after the same time has passed. Also shown in the figure is the upper limit G0 of the adhesion strength G at which the linerless label paper 25 can be separated from the thermal head 35 at the normal transportation force.

More specifically, it will be known from FIG. 6 that under the high temperature condition denoted by curve f1, the linerless label paper 25 can be reliably pulled away from the thermal head 35 if the length of contact is less than time tA where the adhesion strength G is less than or equal to the upper limit G0. Likewise, the linerless label paper 25 can be reliably pulled away under the normal temperature condition denoted by curve f2 if the length of contact is less than time tB (>tA), and can be reliably pulled away under the low temperature condition denoted by curve f3 if the length of contact is less than time tC (>tB).

Based on the foregoing conclusions, this embodiment of the invention acquires the ambient temperature when the printer is left in the paper-in-contact condition, and holds the adhesion strength G at a level not exceeding the upper limit G0 as a result of the controller 42 driving the transportation motor 43 in an operating pattern whereby the linerless label paper 25 is separated and moved a specific distance from the thermal head 35 based on the ambient temperature. This process is referred to herein as the "sticking prevention process."

As described above, the thermal printer 1 has a thermistor 46 for measuring the head temperature. This embodiment of the invention uses the ability of the thermistor 46 to detect the ambient (environmental) temperature when the thermal head 35 is not heating, that is, when the head is off, and acquires the temperature detected by the thermistor 46 at this time as the ambient temperature.

An operating pattern of reversing the roll paper 20 and then feeding the roll paper 20 forward is used for this separating operation pattern. The reason operation starts with reversing the paper is that if operation starts by feeding the paper forward and slipping occurs when first feeding the paper, the linerless label paper 25 may be jerked from the roll paper 20 and linerless label paper 25 slack may accumulate inside the thermal printer 1. If operation starts by reversing the paper, however, this problem can be avoided even if slipping occurs at first. In addition, if operation starts by reversing the paper, the applied torque works as a force separating the linerless label paper 25 from the thermal head 35, and the paper can be separated efficiently.

In addition, by feeding forward a short time after reversing the paper, a large force can be instantly applied to the linerless label paper 25 when feeding is reversed, and separation is easier.

Figure 7A:
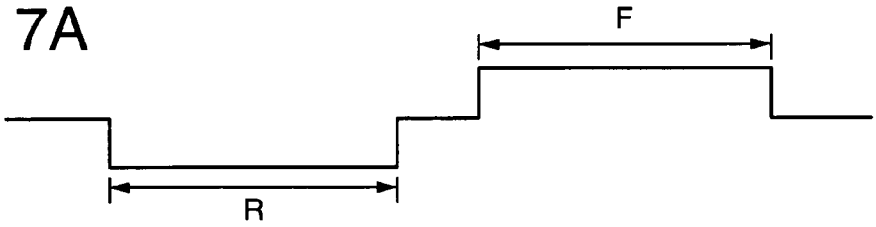
FIG. 7A to FIG. 7C show variations in the operating pattern.
Figure 7B:
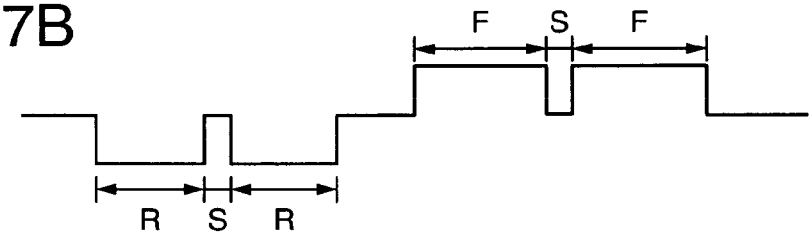
Figure 7C:
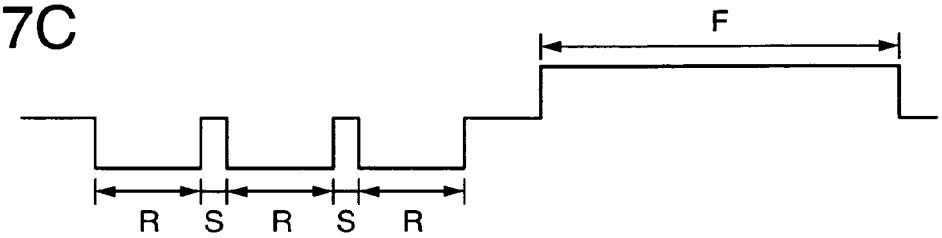

FIG. 7A to FIG. 7C show variations of the operating pattern. In these figures a low period R denotes a reverse feed period, and a high period F denotes a forward feed period, and periods S denote intermittent pauses in the transportation operation. The waveform of this operating pattern is the same as the waveform of the control signal from the controller 42 to the drive unit 44.

FIG. 7A shows the basic operating pattern in which reverse feed continues uninterrupted for low period R, and forward feed then continues uninterrupted for high period F. In this basic operating pattern the reverse period R and forward period F are the same length, and the paper is returned to the same position it was before operation started.

FIG. 7B shows an operating pattern in which a single intermittent pause is inserted when conveying the medium in reverse and when conveying the medium forward, and FIG. 7C shows an operating pattern in which two intermittent pauses are inserted when conveying the medium in reverse and when conveying the medium forward. By thus intermittently stopping operation, the medium can be conveyed intermittently in both directions, and the medium can be more easily separated. In addition, because it is also conceivable that the medium cannot be separated the first time even when this operation is executed, the reverse period R and the forward period F do not need to be the same duration. For example, if the total forward feed time (forward period F) is set longer than the reverse feed time, printing can start reliably from a position on the upstream side from where the last print job stopped.

More specifically, we defined the parameters of these operating patterns as (1) the time interval until the feeding operation starts (operating time interval), (2) the number of reverse and forward feed operations, (3) whether the feed operations are intermittent and how long feeding is interrupted (how many times feeding is interrupted), and (4) the forward and reverse feed distances. Operating patterns that can reliably separate the linerless label paper 25 from the thermal head 35 and keep the adhesion strength G from exceeding the upper limit G0 are set by optimizing these parameters.

This embodiment of the invention changes the operating time interval parameter (1) described above according to the ambient temperature, and treats the other operating pattern parameters as constant. In this configuration the contact time required for the adhesion strength G to rise substantially to the upper limit G0 at each ambient temperature level (comparable to contact times tA, tB, and tC in FIG. 6) is predetermined by measurement or simulation, and the operating time intervals are set to times slightly shorter than these contact times. For example, if the adhesion strength G goes to the upper limit G0 at a contact time of 40 minutes at an ambient temperature of 25° C., the operating time interval is set to 30 minutes.

For example, if the contact time is 40 minutes and a time slightly shorter than this 40 minutes (such as 30 minutes) is set as the operating time interval, the number of operations can be reduced within the time range in which separation is possible, and noise and power consumption can be reduced accordingly. So that the controller 42 can identify the appropriate operating time interval set as described above based on the ambient temperature, a table correlating the ambient temperature to the operating time interval, or an algorithm for calculating the operating time interval from the ambient temperature, is stored in ROM or other memory device.

Figure 8:
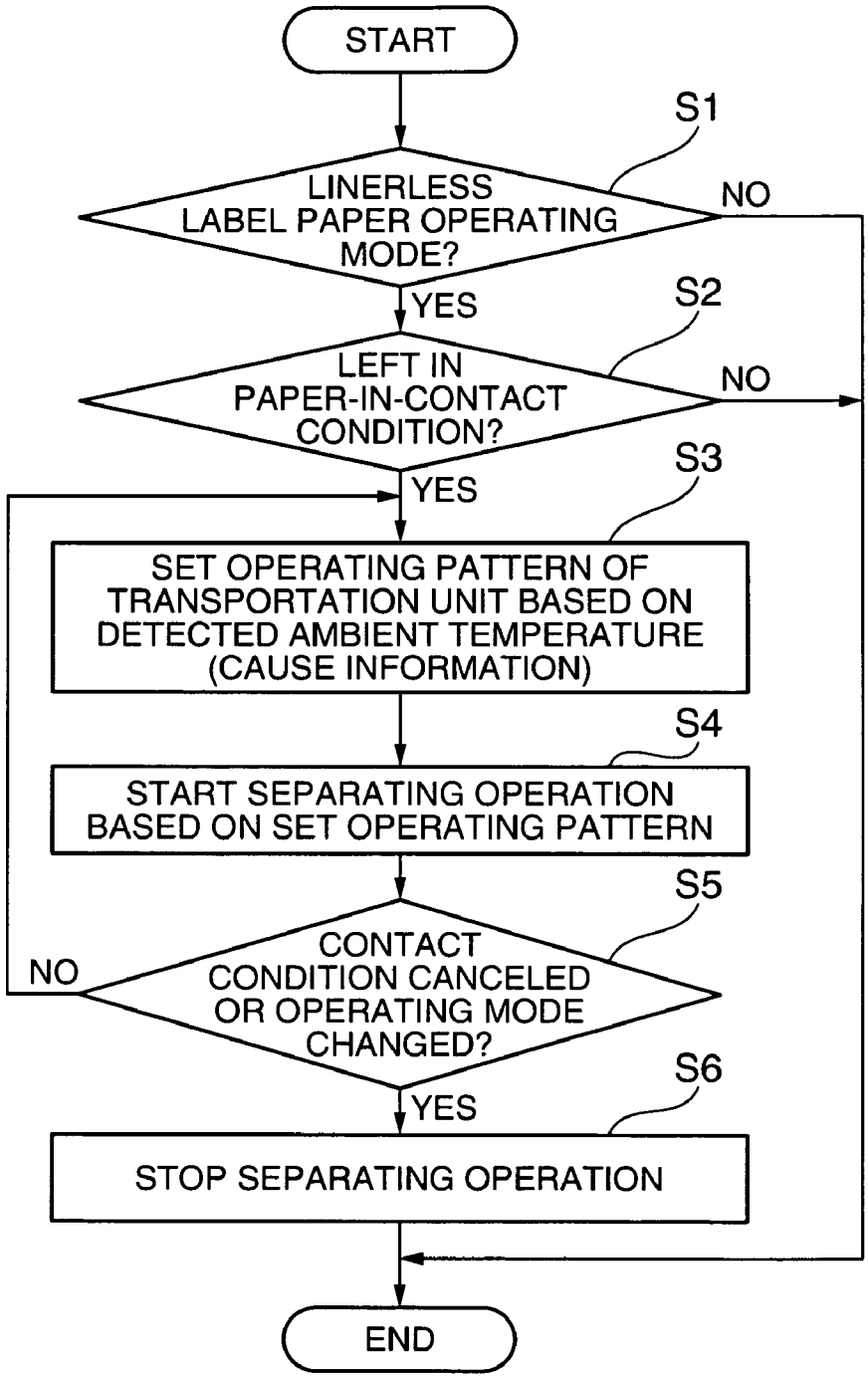
FIG. 8 is a flow chart of the adhesion prevention process.

FIG. 8 is a flow chart of the sticking prevention process. The sticking prevention process is described below using an operating time interval of 10 minutes in a high temperature condition (30° C. or higher), an operating time interval of 15 minutes in a normal temperature condition (25° C.≦30° C.), and an operating time interval of 30 minutes in a low temperature condition (<25° C.), The controller 42 first determines from the state of the input switch 42A whether the linerless label roll paper 20 operating mode is set (step S1). If the linerless label roll paper 20 operating mode is set (step S1 returns Yes), it determines if the printer was left in the paper-in-contact condition (step S2). Whether this paper-in-contact condition has occurred can be determined by, for example, the controller 42 measuring the time spent waiting to receive print data, and deciding that a paper-in-contact condition occurred when this measured time exceeds a threshold value. This threshold value is set to a time that is reliably shorter than the time required for the adhesion strength G to rise to the upper limit G0.

If either step S1 or step S2 returns a negative result (No), the controller 42 ends this process. If step S2 returns a positive result (Yes), the controller 42 acquires the temperature detected by the thermistor 46, and sets the operating pattern of the drive unit 44 based on the detected temperature (step S3). The controller 42 sets the operating pattern with an operating time interval of 10 minutes if the detected temperature is greater than or equal to 30° C., sets the operating pattern with an operating time interval of 15 minutes if the detected temperature is greater than or equal to 25° C. and less than 30° C., and sets the operating pattern with an operating time interval of 30 minutes if the detected temperature is less than 25° C. In other words, the controller 42 sets the operating time interval according to the ambient temperature at the contact time.

The controller 42 then starts the separating operation using the set operating pattern (step S4). In this case the controller 42 starts the intermittent operation of waiting for the operating time interval to pass after the paper-in-contact condition starts, reversing, forwarding, and stopping paper transportation by means of the drive unit 44, then again waiting for the operating time interval to pass after the paper-in-contact condition starts, reversing, forwarding, and stopping paper transportation by means of the drive unit 44, and so forth.

When a specific time passes from when this operation starts, the controller 42 determines if the paper-in-contact condition was cancelled or if the operating mode changed (step S5). Cancellation of the paper-in-contact condition means that print data was input, and a change in the operating mode means that the input switch 42A state changed.

If the paper-in-contact condition continues and the operating mode did not change (step S5 returns No), the controller 42 returns to step S3, reads the temperature detected by the thermistor 46 again, sets the operating pattern corresponding to the acquired detection temperature, and continues the separation process.

However, if the paper-in-contact condition was cancelled or the operating mode changed (step S5 returns Yes), the controller 42 stops the separating operation (step S6). Note that because the sticking prevention process is executed repeatedly on a regular cycle when the main power of the thermal printer 1 is turned on, transportation control separating the linerless label paper 25 from the thermal head 35 is executed reliably whenever a paper-in-contact condition occurs.

As described above when the linerless label paper 25 is left in contact with the thermal head 35 for some period of time, the controller 42 in this embodiment of the invention sets the operating pattern whereby the linerless label paper 25 is separated and moved a specific distance from the thermal head 35 according to the conditions in which the paper was left in contact, and conveys the paper according to this set operating pattern. As a result, the linerless label paper 25 is separated before the adhesion strength G between the linerless label paper 25 and thermal head 35 exceeds the upper limit G0.

Therefore, even if the linerless label paper 25 and thermal head 35 are stuck together when printing starts, the linerless label paper 25 can be reliably separated from the thermal head 35 using the normal transportation force used for printing, and the adhesion strength G is prevented from exceeding the upper limit G0 because this transportation control is applied intermittently. Paper transportation problems at the start of printing can therefore be avoided, and any deviation in the feed pitch when paper transportation starts or paper transportation errors resulting from such paper transportation problems can be avoided.

Furthermore, because the operating pattern conveys the paper first in reverse and then forward, problems that can occur when operation starts with forward transportation, such as paper slack accumulating inside the thermal printer 1 because the linerless label paper 25 is jerked from the roll paper 20, are prevented and the paper can be efficiently separated from the thermal head 35.

Because the controller 42 in this embodiment of the invention acquires the ambient temperature (cause information) that affects the adhesion strength between the linerless label paper 25 and thermal head 35, and sets the operating pattern based on the detected temperature, an operating pattern that avoids needless operation can be set, and noise and power consumption can be reduced. In other words, by increasing the operating time interval of the operating pattern as the ambient temperature drops, the printer 1 can be prevented from operating frequently when not printing. Furthermore, because the ambient temperature is measured by the thermistor 46 that measures the head temperature, a separate temperature sensor for measuring the ambient temperature is not needed, and the parts count can be reduced.

Furthermore, because the operating pattern is set and transportation is controlled based on the operating pattern only when the linerless label roll paper 20 operating mode is selected by the input switch 42A, which is used to change the operating mode, applying control to prevent sticking when normal roll paper that does not stick to the thermal head 35 is used can be reliably prevented.

It will be noted that the foregoing embodiment is just one embodiment of the invention, and various modifications and improvements that are within the scope of the accompanying claims will be obvious to one with ordinary skill in the related art. For example, the embodiment described above acquires information about the ambient temperature as information about a cause (cause information) that has an effect on the adhesion strength between the linerless label paper 25 and thermal head 35, and sets the operating pattern based on this information, but the invention is not so limited. For example, because adhesive left on the release coating layer 25D absorbs more moisture and the adhesion strength rises as the humidity rises, a humidity sensor may be disposed and the operating pattern may be set according to the humidity detected by this sensor. Further alternatively, the operating pattern may be set based on a combination of both temperature and humidity.

Yet further, the operating pattern parameter that changes according to the cause information is not limited to (1) the operating time interval, and a different parameter (such as 2) the number of reverse and forward feed operations, 3) whether the feed operations are intermittent and how long feeding is interrupted (how many times feeding is interrupted), and 2) the forward and reverse feed distances) may be used instead. It will be noted that the operating pattern parameter may be used at least one of 2), 3) and 4).

Yet further, the operating pattern may be changed in the foregoing embodiment according to the cumulative time until the print data wait time, that is, according to the cumulative contact time. For example, an operating pattern may be set with a relatively short time interval (such as 10 minutes) until the cumulative time reaches a threshold time (such as 10 minutes), and an operating pattern with a relatively long time interval (such as 20 minutes) may be set after this threshold time is exceeded.

The operating pattern may also be set in the foregoing embodiment immediately after the thermal printer 1 power turns on, and media transportation may be controlled according to this operating pattern. This enables eliminating any sticking problems before printing starts.

The invention is applied in the foregoing embodiment to a printer that records images to linerless label paper having a release coating on the surface, but the sticking problem is not limited to this linerless label paper. More particularly, recording medium having an overcoating layer to protect the surface can also quickly stick to the head surface of the thermal head, therefore the printer can also be used in printers that record images on recording medium having a surface coating that may stick to the thermal head.

Yet further, the control program for executing the foregoing process is prestored in the thermal printer 1, but the control program may be stored on magnetic recording media, optical recording media, semiconductor recording media, or other type of computer-readable recording medium, and the control program may be read and executed from such recording media by a computer. The control program may also be downloaded from a server device, for example, over a computer network.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A recording device comprising:

a transportation unit that conveys a recording medium;

a thermal head that records images to the recording medium; and a control unit that, when the recording medium has a release coat layer or an overcoating layer, sets an operating pattern and controls the transportation unit according to the operating pattern, wherein:

the control unit acquires cause information that affects adhesion strength between the recording medium and the thermal head, and sets the operating pattern based on the cause information.

2. The recording device described in claim 1, wherein:

the control unit sets the operating pattern that causes the recording medium to be conveyed in reverse and then forward.

3. The recording device described in claim 1, wherein:

the control unit sets an operating time interval of the transportation unit, and at least one of whether operation is intermittent during reverse transportation and forward transportation and the number of intermittent operations, based on the cause information.

4. The recording device described in claim 1, wherein:

the cause information is at least one of temperature and humidity.

5. The recording device described in claim 1, wherein:

the recording medium is linerless label paper having a release coat layer on the front and an adhesive layer on the back, and is pulled from a condition in which the adhesive layer is on top of the release coat layer and conveyed by the transportation unit.

6. A control method for a recording device that has a transportation unit that conveys a recording medium, and a thermal head that records images to the recording medium, the control method comprising a step of:

detecting, when a recording medium having a release coat layer or an overcoating layer is left in contact with the thermal head, a contact condition, setting, an operating pattern for moving the surface of the recording medium a specific distance relative to the thermal head according to the contact condition, and controlling the transportation unit according to the operating pattern;

wherein the contact condition is a cause information that affects adhesion strength between the recording medium and the thermal head.

7. The control method described in claim 6 further comprising a step wherein:

the recording medium is linerless label paper having a release coat layer on the front and an adhesive layer on the back, and is pulled from a condition in which the adhesive layer is on top of the release coat layer and conveyed.

8. A control program for controlling by means of a computer a recording device that has a transportation unit that conveys a recording medium, and a thermal head that records images to the recording medium, the control program causing the computer to function as a control unit that, when a recording medium having a release coat layer or an overcoating layer is left in contact with the thermal head, detects a contact condition, sets an operating pattern according to the contact condition for moving the surface of the recording medium a specific distance from the thermal head, and controls the transportation unit according to the operating pattern, wherein the contact condition is a cause information that affects adhesion strength between the recording medium and the thermal head.

* * * * *